US008115408B2

(12) United States Patent
Liu et al.

(10) Patent No.: US 8,115,408 B2
(45) Date of Patent: Feb. 14, 2012

(54) LIGHT SOURCE APPARATUS AND LIGHT SOURCE ADJUSTING MODULE

(75) Inventors: Yi-Te Liu, Hsinchu County (TW); Chih-Jen Yen, Hsinchu (TW); Chih-Yuan Hsieh, Hsinchu (TW); Lan-Shan Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 501 days.

(21) Appl. No.: 12/273,525

(22) Filed: Nov. 18, 2008

(65) Prior Publication Data

US 2009/0315475 A1 Dec. 24, 2009

(30) Foreign Application Priority Data

Jun. 19, 2008 (TW) ..... 97122864 A

(51) Int. Cl.
*H05B 37/02* (2006.01)

(52) U.S. Cl. ..... 315/291; 315/209 R; 315/247; 315/307; 315/308; 323/207; 323/211; 323/212; 323/283; 363/17; 363/19; 363/21.13; 363/148

(58) Field of Classification Search ..... 315/209 R, 315/224–226, 247, 291, 293, 294, 297, 307, 315/308, 316; 323/207, 211, 212, 215, 220, 323/283, 285, 337, 355; 363/15, 17, 19, 363/21.01–21.13, 108, 118, 132, 148
See application file for complete search history.

(56) References Cited

U.S. PATENT DOCUMENTS

| | | | | |
|---|---|---|---|---|
| 4,051,425 | A * | 9/1977 | Smith | 363/86 |
| 6,246,183 | B1 * | 6/2001 | Buonavita | 315/248 |
| 7,057,359 | B2 * | 6/2006 | Hung et al. | 315/291 |
| 7,667,408 | B2 * | 2/2010 | Melanson et al. | 315/209 R |
| 2005/0253533 | A1 * | 11/2005 | Lys et al. | 315/224 |
| 2008/0024656 | A1 * | 1/2008 | Huang | 348/372 |
| 2008/0054817 | A1 * | 3/2008 | Kao et al. | 315/209 R |

* cited by examiner

*Primary Examiner* — Douglas W Owens
*Assistant Examiner* — Thai Pham
(74) *Attorney, Agent, or Firm* — Jianq Chyun IP Office

(57) ABSTRACT

A light source apparatus and a light source adjusting module are provided. The light source apparatus includes a power supply, a phase modulator, an electrical transformer, a light source adjusting module and a light-emitting device. The power supply provides a first AC voltage signal. The phase modulator receives the first AC voltage signal and adjusts a conducting phase of the first AC voltage signal to generate a modulated AC voltage signal. The electrical transformer transforms the modulated AC voltage signal to generate a second AC voltage signal. The light adjusting module generates a luminance adjusting signal according to a state of the second AC voltage signal. The light-emitting device receives the luminance adjusting signal to generate a corresponding light source.

17 Claims, 9 Drawing Sheets

LIGHT SOURCE APPARATUS AND LIGHT SOURCE ADJUSTING MODULE

CROSS-REFERENCE TO RELATED APPLICATION

This application claims the priority benefit of Taiwan application serial no. 97122864, filed on Jun. 19, 2008. The entirety of the above-mentioned patent application is hereby incorporated by reference herein and made a part of specification.

BACKGROUND OF THE INVENTION

1. Field of the Invention

The present invention relates to a light source adjusting technique. More particularly, the present invention relates to a light source apparatus and a light source adjusting module.

2. Description of Related Art

FIG. 1 is a block diagram illustrating a light-emitting device applying a MR16 halogen lamp. Referring to FIG. 1, a power supply 110 provides an alternating current (AC) voltage signal (for example an 110V AC voltage signal). Next, a phase modulator 120 modulates a conducting phase of the AC voltage signal. An electrical transformer 130 transforms the modulated 110V AC voltage signal to the 12V or 24V AC voltage signal for outputting to an MR16 halogen lamp 140, so as to lighten the MR16 halogen lamp 140. Since the AC voltage signal generated by the electrical transformer 130 contains light-adjusting data, it may adjust a luminance of the MR16 halogen lamp 140. Therefore, in the light-emitting apparatus of FIG. 1, the luminance of the MR16 halogen lamp 140 can be adjusted by controlling the conducting phase of the AC voltage signal, so as to achieve a light-adjusting effect.

Though the halogen lamp has an advantage of high luminance, it also has disadvantages of high power consumption, short lifetime and high temperature, etc. With development of technology, light emitting diodes (LED) having features of long lifetime, high efficiency, light-weighted, etc. are developed. Therefore, the MR16 halogen lamp can be substituted by the LED, so that the MR16 lamp apparatus may share the advantages of the LED.

FIG. 2 is a block diagram illustrating an MR16 light-emitting device applying an LED. Referring to FIG. 2, functions of a power supply 210, a phase modulator 220 and an electrical transformer 230 of FIG. 2 is the same to that of the power supply 110, the phase modulator 120 and the electrical transformer 130 of FIG. 1, and therefore detailed descriptions thereof will not be repeated. A difference between FIG. 2 and FIG. 1 is that the light-emitting devices connected to the electrical transformers are different. In FIG. 1, the electrical transformer 130 is connected to the MR16 halogen lamp 140, and in FIG. 2, the electrical transformer 230 is connected to a bridge rectifier 240, a driver 250 and an LED 260. Namely, the bridge rectifier 240 receives the 12V or 24V AC voltage signal generated by the electrical transformer 230, and rectifies the AC voltage signal into a direct current (DC) voltage signal. Then, the DC voltage signal is provided to the driver 250 to drive the LED 260, so that the LED 260 may generate a light source. The bridge rectifier 240, the driver 250 and the LED 260 form a light-emitting module, and a lamp head utilized by the light-emitting module is complied with an MR16 specification.

However, the conventional driver 250 cannot detect the conducting phase information of the AC voltage signal modulated by the phase modulator 220. Namely, the driver 250 cannot control the luminance of the LED 260 according to the conducting phase information modulated by the phase modulator 220. Therefore, to control the luminance of the LED 260, extra pins are added to the driver 250, and a variable resistor VR is connected. Next, by adjusting a resistance of the variable resistor VR, the luminance of the LED 260 can be adjusted. However, such structure is different to the MR16 lamp apparatus specification (since the pins required for connecting the variable resistor are added), so that the original MR16 lamp apparatus specification cannot be directly applied to the LED 260, and therefore utilization thereof is inconvenient.

SUMMARY OF THE INVENTION

The present invention is directed to a light source apparatus and a light source adjusting module, by which a compatibility problem can by effectively resolved, and utilization of extra pins can be avoided, so as to save a fabrication cost.

The present invention provides a light source apparatus including a power supply, a phase modulator, an electrical transformer, a light source adjusting module and a light-emitting device. The power supply provides a first AC voltage signal. The phase modulator is coupled to the power supply for receiving the first AC voltage signal and adjusting a conducting phase of the first AC voltage signal to generate a modulated AC voltage signal. The electrical transformer is coupled to the phase modulator for transforming the modulated AC voltage signal to generate a second AC voltage signal. The light source adjusting module is coupled to the electrical transformer for generating a luminance adjusting signal according to a state of the second AC voltage signal. The light-emitting device is coupled to the light source adjusting module for receiving the luminance adjusting signal to generate a corresponding light source.

The present invention provides a light source adjusting module including a converting unit, a counting and storage unit, a digital-to-analog converter (DAC) and a current regulator. The converting unit receives a modulated AC voltage signal and converts the modulated AC voltage signal into a pulse signal, wherein the modulated AC voltage signal is generated by adjusting a conducting phase of an AC voltage signal. The counting and storage unit is coupled to the converting unit for counting and storing a quantity of pulses of the pulse signal. The DAC is coupled to the counting and storage unit for correspondingly generating a current control signal according to the quantity of the pulses the pulse signal. The current regulator is coupled to the DAC for correspondingly generating a luminance adjusting signal according to the current control signal.

The present invention provides a light source adjusting module including a reference signal modulator and a current regulator. The reference signal modulator receives a modulated AC voltage signal and correspondingly generates a current control signal according to the modulated AC voltage signal. The current regulator is coupled to the reference signal modulator for correspondingly generating a luminance adjusting signal according to the current control signal.

The present invention provides a light source adjusting module including a DAC and a current regulator. The DAC receives a modulated AC voltage signal and performs a digital-to-analog conversion to the modulated AC voltage signal to generate a current control signal. The current regulator is coupled to the DAC for correspondingly generating a luminance adjusting signal according to the current control signal.

In the present invention, the light source adjusting module detects a state of the second AC voltage signal to obtain information of the modulated AC voltage signal of the phase modulator, so as to control the luminance of the light-emitting device (LED). By such means, the light source apparatus and the light source adjusting module of the present invention is complied with an MR16 lamp apparatus specification (certainly, can also be complied with E26 and E27 lamp apparatus specifications). Therefore, utilization convenience can be improved. Moreover, extra pins and connection of a variable resistor for the light source apparatus are unnecessary, and accordingly fabrication cost of the circuit is reduced.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
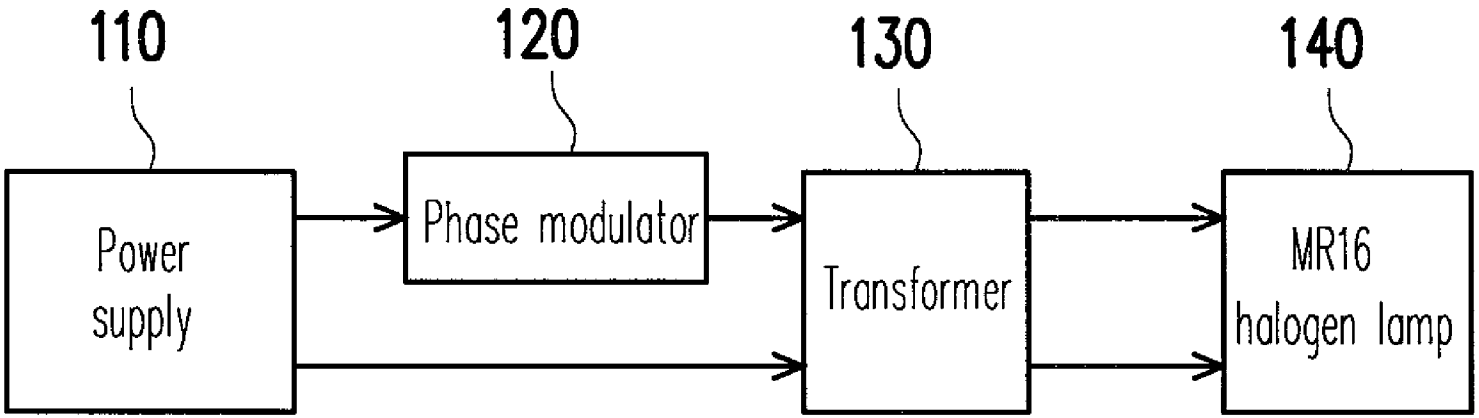
FIG. 1 (PRIOR ART)
FIG. 1 is a block diagram illustrating a light-emitting device applying a MR16 halogen lamp.
Figure 2:
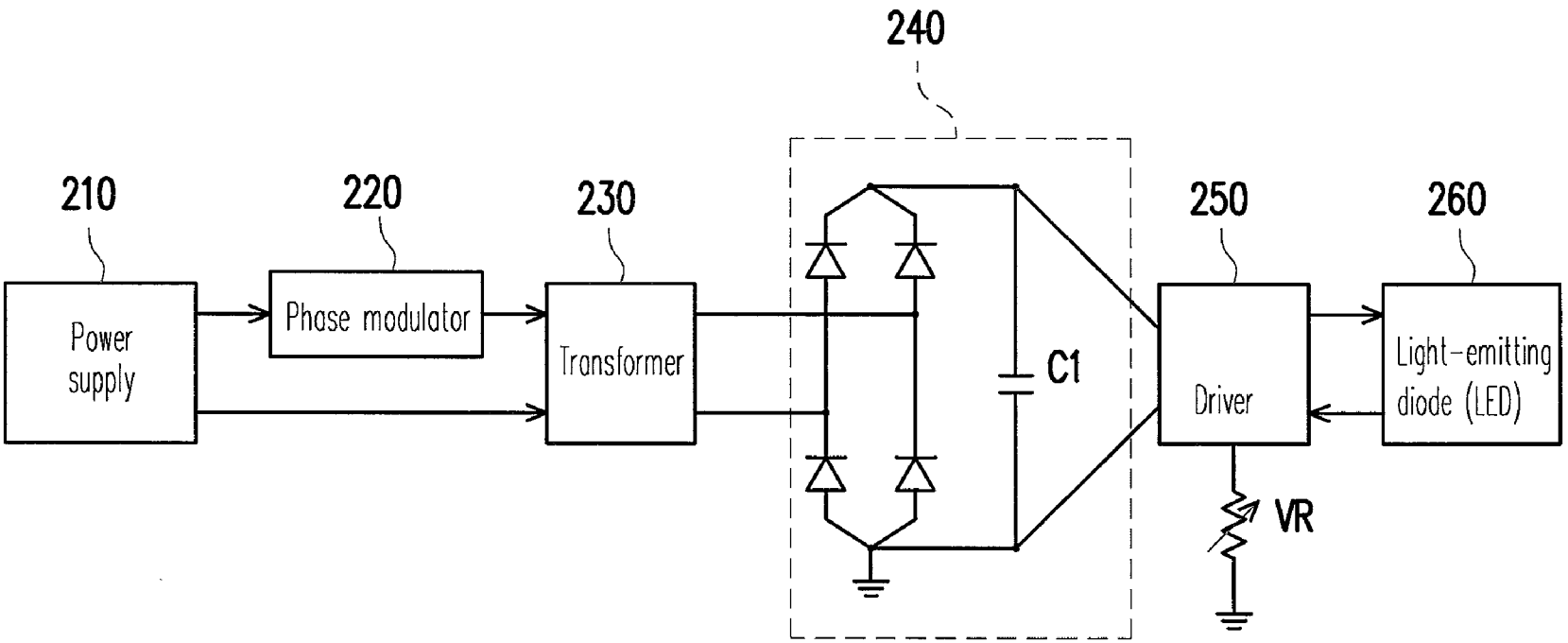
FIG. 2 (PRIOR ART)
FIG. 2 is a block diagram illustrating an MR16 light-emitting device applying an LED.
Figure 3:
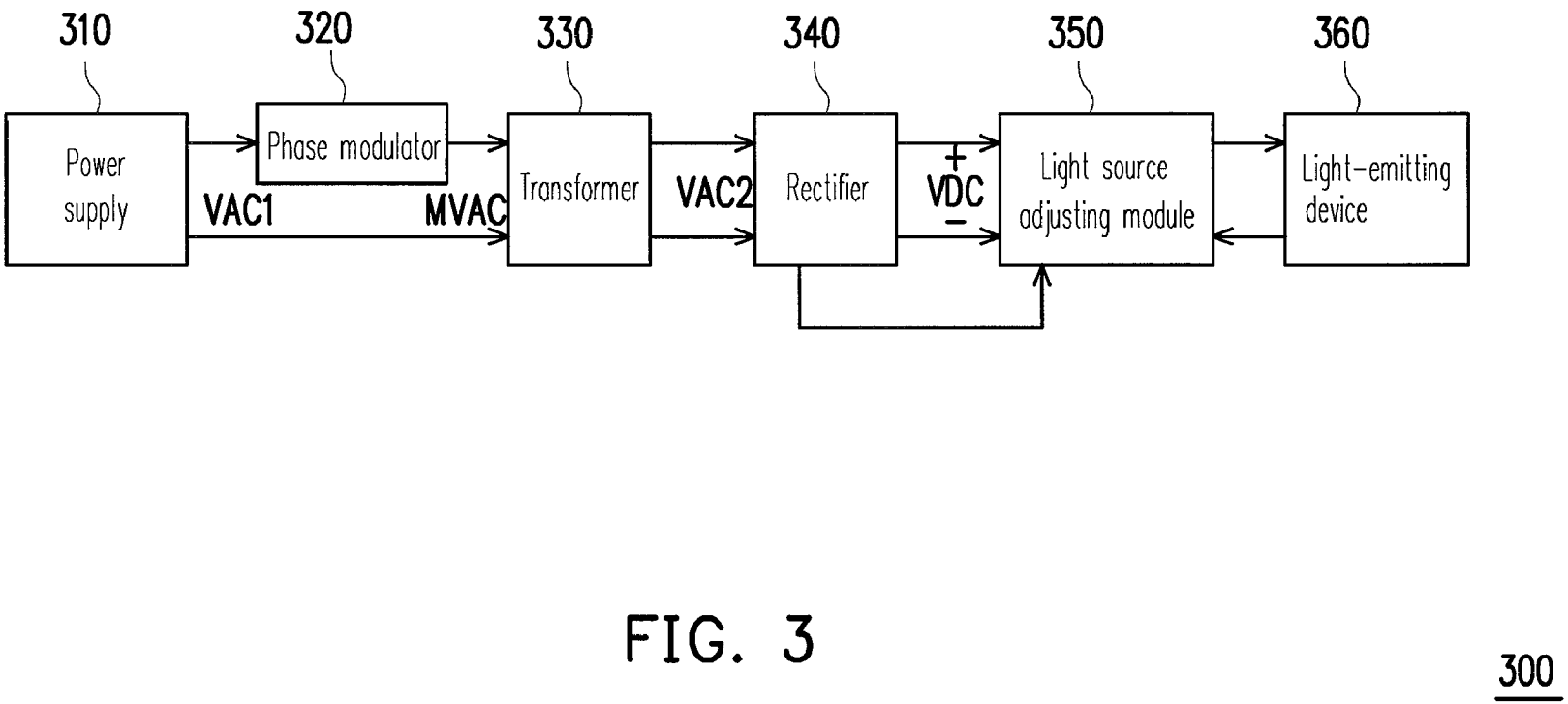
FIG. 3 is a block diagram illustrating a light source apparatus according to an embodiment of the present invention.

FIG. 3 is a block diagram illustrating a light source apparatus according to an embodiment of the present invention. Referring to FIG. 3, the light source apparatus 300 includes a power supply 310, a phase modulator 320, an electrical transformer 330, a rectifier 340, a light source adjusting module 350 and a light-emitting device 360. The power supply 310 provides an AC voltage signal VAC1, for example, an 110V AC voltage signal. The phase modulator 320 is coupled to the power supply 310 for receiving the AC voltage signal VAC1 and modulating a conducting phase of the AC voltage signal VAC1 to generate a modulated AC voltage signal MVAC. Wherein, the modulated AC voltage signal MVAC can serve as a basis for adjusting a luminance of the light-emitting device 360.

The electrical transformer 330 is coupled to the phase modulator 320 for receiving and transforming the modulated AC voltage signal MVAC, so as to generate an AC voltage signal VAC2. In the present embodiment, for example, the electrical transformer 330 can be a buck electrical transformer which can transform (buck) the 110V AC voltage signal VAC1 into a 12V or 24V AC voltage signal VAC2. However, the type or kind of the electrical transformer 330 is not used to limit the present invention.

The rectifier 340 is coupled to the electrical transformer 330 for rectifying the AC voltage signal VAC2, so as to generate a DC voltage signal VDC. Moreover, the DC voltage signal VDC generated by the rectifier 340 can serve as a working voltage signal for the light source adjusting module 350 (i.e. function as a supply power for the light source adjusting module 350).

The light source adjusting module 350 is coupled to the rectifier 340 for receiving the DC voltage signal VDC, and generating a light source adjusting signal according to a state of the AC voltage signal VAC2. The light-emitting device 360 is coupled to the light source adjusting module 350 for receiving the light source adjusting signal to generate a corresponding light source. In the present embodiment, the light-emitting device 360 is a LED, and the light source adjusting signal can be a current or a voltage signal used for driving the LED 360. Moreover, according to the aforementioned design, specification of the whole light source apparatus 300 can be MR16, E26, E27 or other types of lamp apparatus specification.

In the present embodiment, since the AC voltage signal VAC2 is generated by transforming the modulated AC voltage signal MVAC via the electrical transformer 330, the AC voltage signal VAC2 also includes information for adjusting the luminance of the light-emitting device 360. Therefore, the light source apparatus 300 can detect the state of the AC voltage signal VAC2 via the light source adjusting module 350, so as to obtain information for adjusting the luminance of the light-emitting device 360. Next, the light source adjusting module 350 can generate a corresponding light source adjusting signal according to the above light-adjusting information, and transmit the light source adjusting signal to the light-emitting device 360, so as to adjust the luminance of the light-emitting device 360.

By such means, the conventional lamp apparatus specification can be directly applied to the light source apparatus 300 of the present embodiment, and the originally existed light-adjusting apparatus (i.e. the power supply 310, the phase modulator 320 and the electrical transformer 330) can directly adjust the luminance of the light-emitting device 360. Therefore, in the present invention, the MR16 lamp apparatus specification can be directly utilized, so that utilization convenience is improved. Moreover, extra pins and connection of a variable resistor for the light source apparatus 300 are unnecessary, so that fabrication cost of the circuit can be reduced.

To fully explain how the light source adjusting module 350 of the light source apparatus 300 generates the light source adjusting signal to those skilled in the art, in the following content, another embodiment is provided for describing the light source adjusting module 350 in detail.

Figure 4:
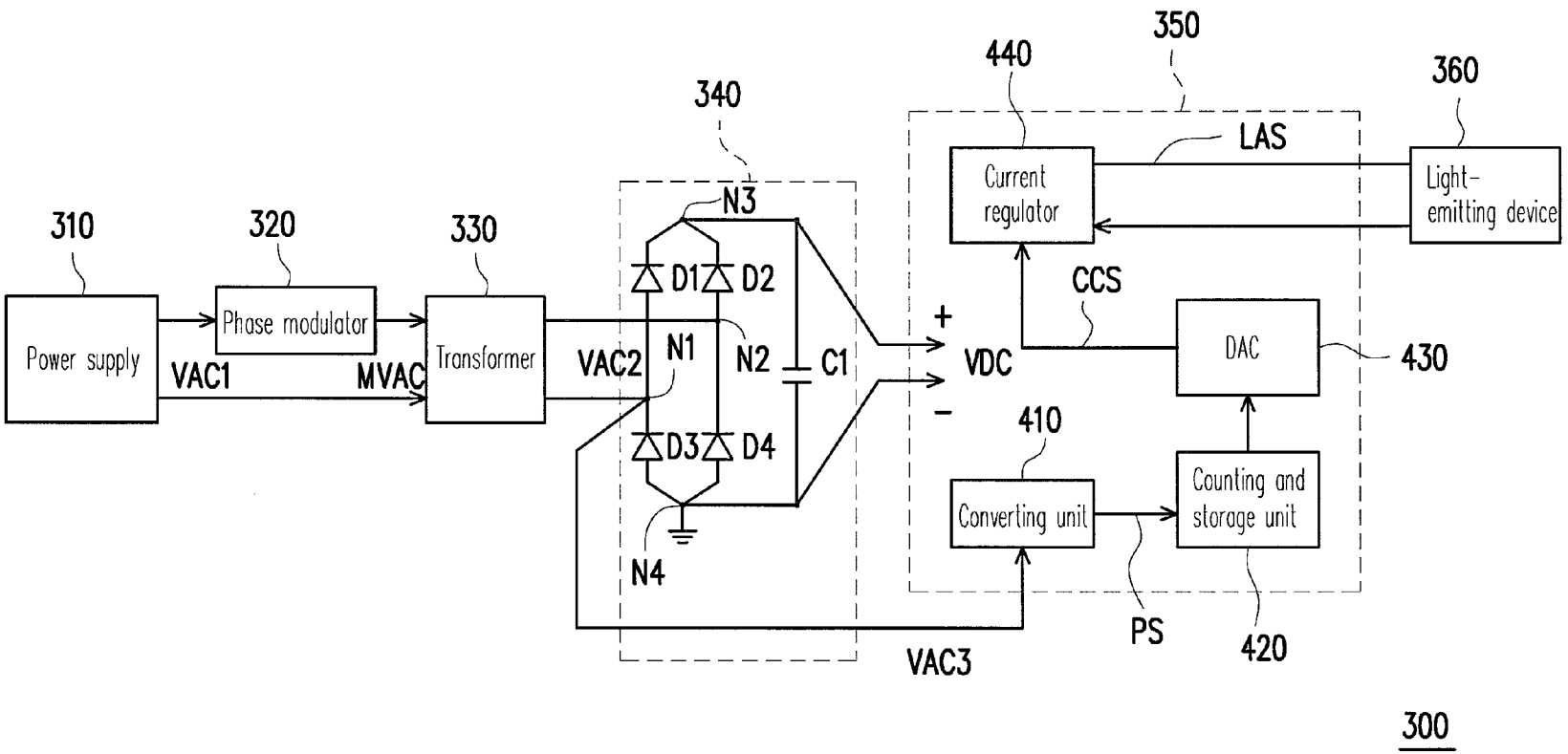
FIG. 4 is a circuit block diagram illustrating a light source apparatus according to an embodiment of the present invention.

FIG. 4 is a circuit block diagram illustrating a light source apparatus 300 according to an embodiment of the present invention. Referring to FIG. 4, in the present embodiment, the rectifier 340 is implemented by a bridge rectifier. However, the rectifier 340 can also be implemented via other techniques according to an actual requirement. The rectifier 340 includes diodes D1-D4 and a capacitor C1. The rectifier 340 receives the AC voltage signal VAC2 via nodes N1 and N2. An anode of the diode D1 is coupled to the node N1, and a cathode of the diode D1 is coupled to a node N3. An anode of the diode D2 is coupled to the node N2, and a cathode of the diode D2 is coupled to the cathode of the diode D1. An anode of the diode D3 is coupled to a node N4, and a cathode of the diode D3 is coupled the anode of the diode D1. An anode of the diode D4 is coupled the anode of the diode D3, and a cathode of the diode D4 is coupled to the anode of the diode D2. The capacitor C1 is coupled between the nodes N3 and N4. In the present embodiment, the not N4 can be a reference ground point.

Figure 5:
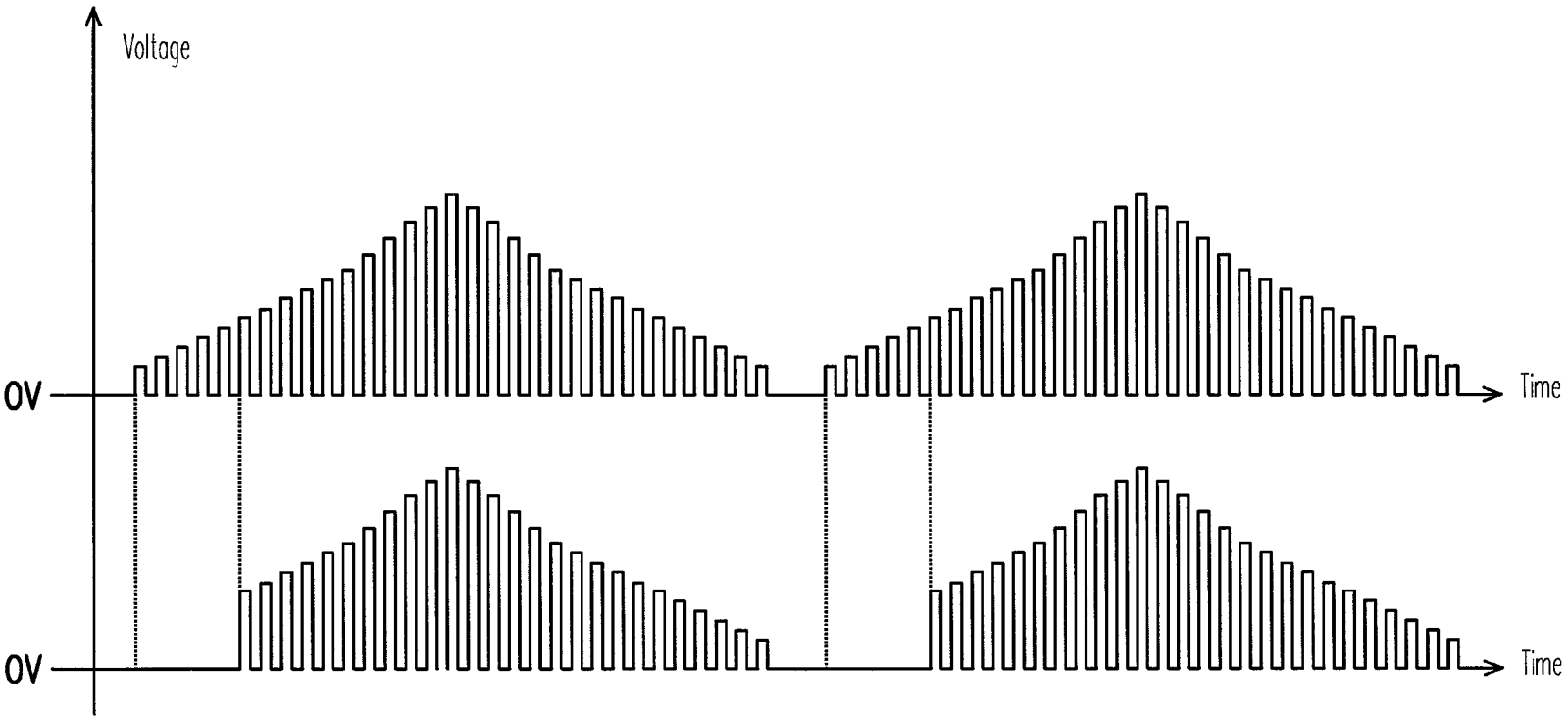
FIG. 5 is a signal waveform diagram of AC voltage signals on a node N1 and a node N2.

Moreover, referring to FIG. 4 again, the light source adjusting module 350 includes a converting unit 410, a counting and storage unit 420, a DAC 430 and a current regulator 440. The converting unit 410 receives an AC voltage signal VAC3 and converts the AC voltage signal VAC3 into a pulse signal PS having the same voltage. It is known that the AC voltage signal VAC3 is an AC voltage signal having a pulse nature. Referring to FIG. 5, FIG. 5 is a signal waveform diagram of AC voltage signal on the nodes N1 and N2. In FIG. 5, the upper signal waveform is an AC voltage signal with a phase thereof being un-modulated, and the lower signal waveform is a phase-modulated AC voltage signal. As shown in FIG. 5, the AC voltage signal has a pulse nature, and the quantity of pulses can be modulated by modulating the phase of the signal. For example, the quantity of the pulses is decreased for the phase-modulated signal waveform.

It should be noted that in the present embodiment, the luminance of the light-emitting device 360 can be adjusted according to the decreased quantity of the pulses.

Figure 6B:
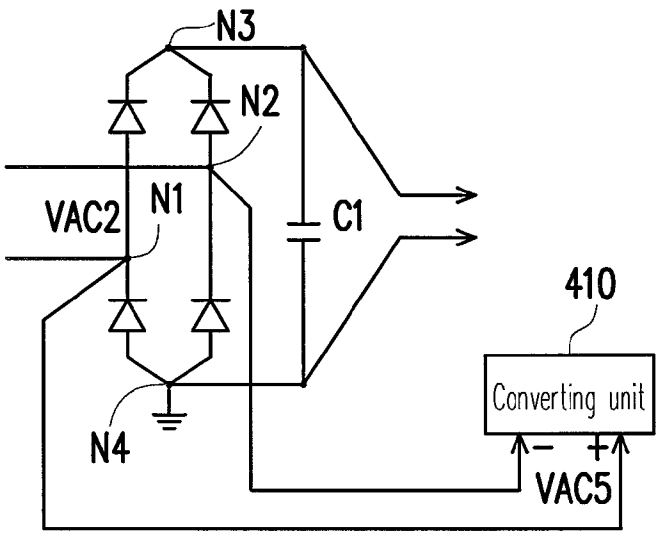
FIG. 6A and FIG. 6B are circuit diagrams of a portion of a light source apparatus according to an embodiment of the present invention.
Figure 6A:
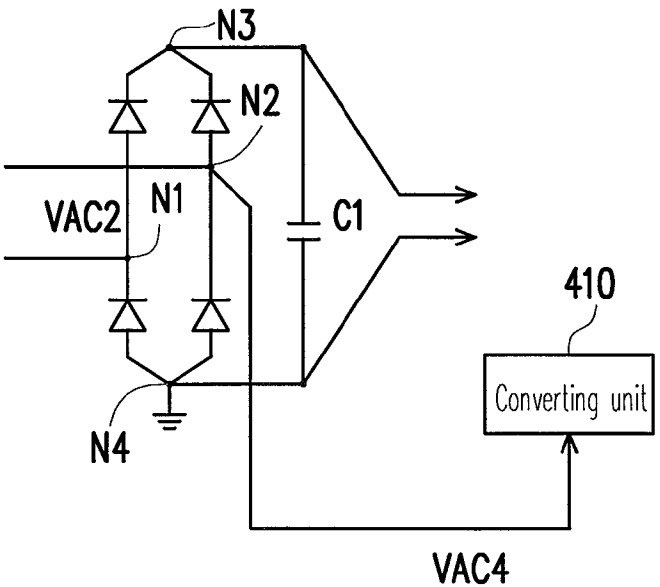

In the present embodiment, the converting unit 410 can receive the AC voltage signal VAC3 from the node N1, and convert the AC voltage signal VAC3 into the pulse signal PS having the same voltage pulse waveform (i.e. each pulse of the pulse signal PS has the same amplitude). Of course, the present embodiment is not limited thereto. For example, the converting unit 410 can also receives an AC voltage signal VAC4 from the node N2, or receives an AC voltage signal VAC5 simultaneously from the two nodes N1 and N2 (i.e. a differential signal), as shown in FIG. 6A and FIG. 6B.

The counting and storage unit 420 is coupled to the converting unit 410 for counting and storing the quantity of pulses of the pulse signals PS. For example, the counting and storage unit 420 counts the quantity of the pulses of the pulse signals PS generated by the converting unit 410 during each period, and stores a counting result. Then, the counting and storage unit 420 transmits the counting result to the DAC 430 to serve as a basis for generating a current control signal CCS.

The DAC 430 is coupled to the counting and storage unit 420 for converting the quantity of the pulses of the pulse signals PS into a corresponding current control signal CCS. The current regulator 440 is coupled to the DAC 430 for receiving the current control signal CCS and correspondingly generating a luminance adjusting signal LAS according to the current control signal CCS, so as to control the luminance of the LED 360.

In other words, the DAC 430 controls the luminance adjusting signal LAS generated by the current regulator 440 according to the counting result of the counting and storage unit 420 (the counting result corresponds to the conducting phase), so as to control the luminance of the LED 360.

Figure 7:
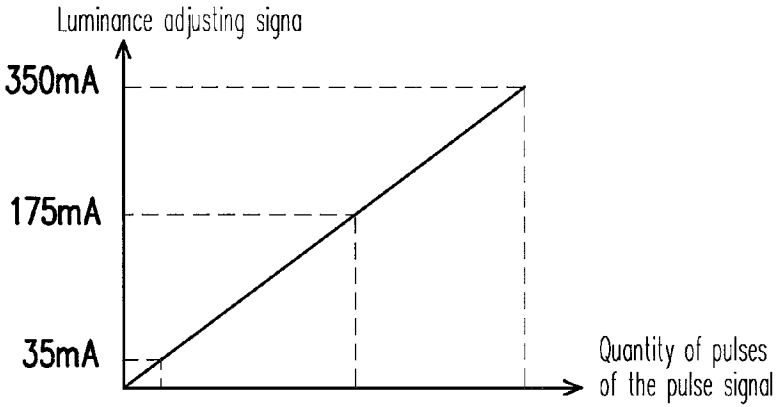
FIG. 7 is a diagram illustrating a relationship between a quantity of the pulses of the pulse signal and luminance adjusting signals LAS.

Referring to FIG. 7, FIG. 7 is a diagram illustrating a relationship between the quantity of the pulses of the pulse signal and the luminance adjusting signals LAS. According to FIG. 7, when the quantity of the pulses of the pulse signal is 20, the luminance adjusting signal LAS generated by the current regulator 440 is 35 mA; when the quantity of the pulses of the pulse signal is 100, the luminance adjusting signal LAS generated by the current regulator 440 is 175 mA; and when the quantity of the pulses of the pulse signal is 200, the luminance adjusting signal LAS generated by the DAC 430 is 350 mA.

Figure 8:
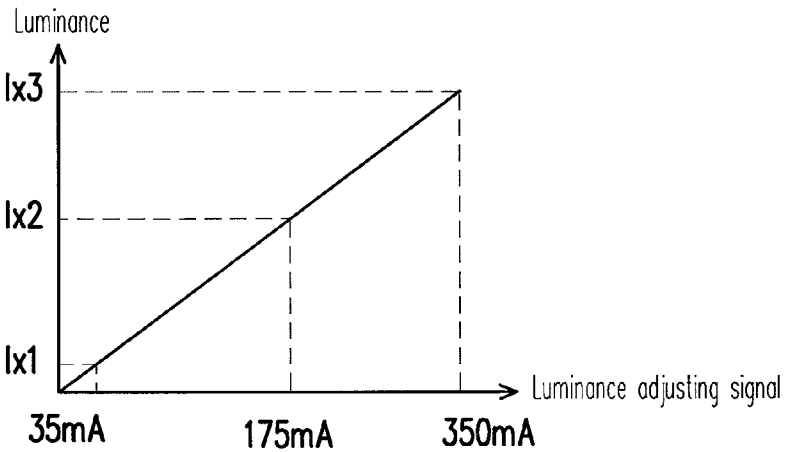
FIG. 8 is a diagram illustrating a relationship between luminance adjusting signal LAS and luminance.

Moreover, referring to FIG. 8, FIG. 8 is a diagram illustrating a relationship between the luminance adjusting signal LAS and the luminance. As shown in FIG. 8, the luminance adjusting signal LAS generated by the current regulator 440 can influence the luminance of the light-emitting device 360. When the luminance adjusting signal LAS is 35 mA, the luminance of the light-emitting device 360 is 1×1; when the luminance adjusting signal LAS is 175 mA, the luminance of the light-emitting device 360 is 1×2; and when the luminance adjusting signal LAS is 350 mA, the luminance of the light-emitting device 360 is 1×3, wherein the luminance 1×3 is larger than the luminance 1×2, and the luminance 1×2 is larger than the luminance 1×1.

Figure 9:
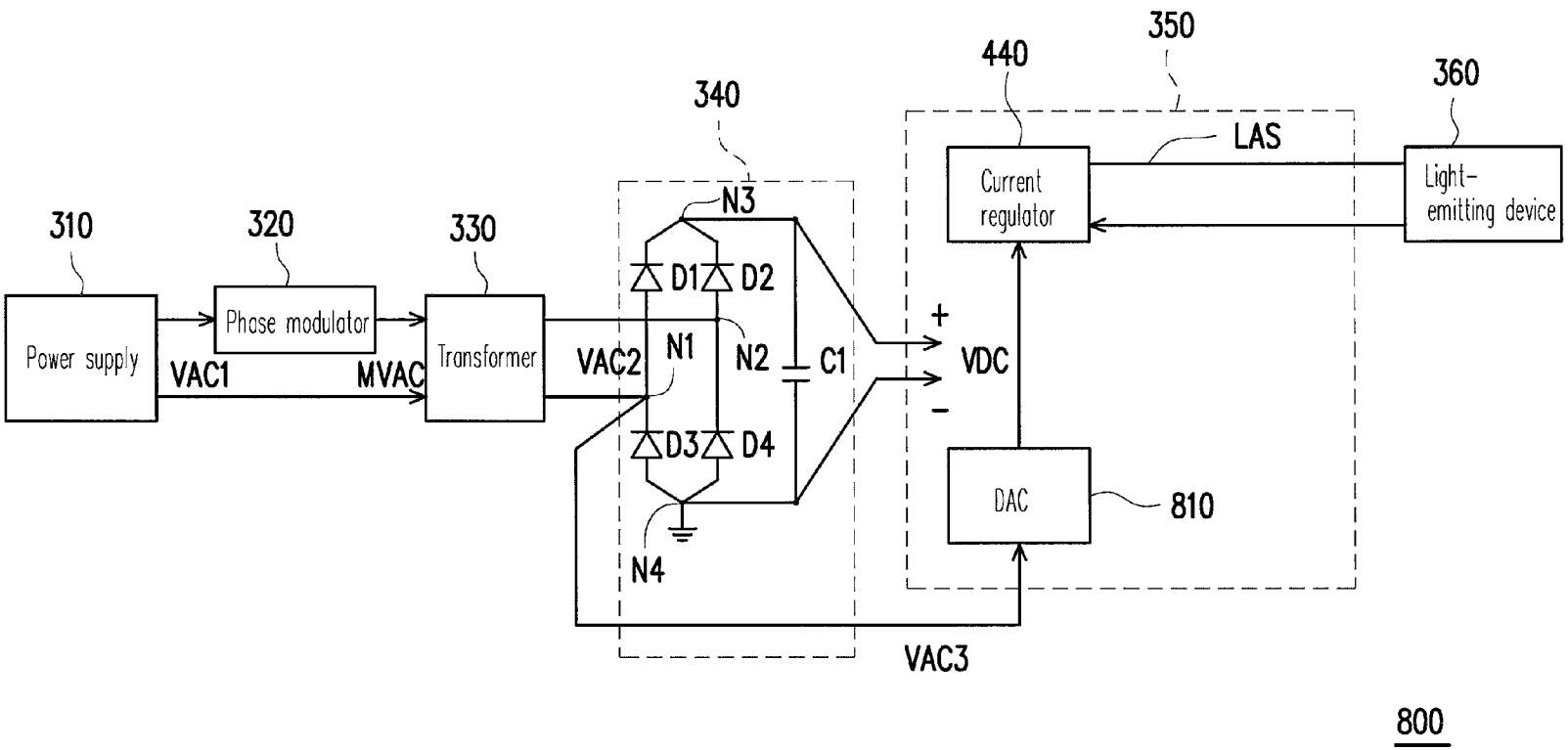
FIG. 9 is a circuit block diagram illustrating a light source apparatus according to another embodiment of the present invention.

FIG. 9 is a circuit block diagram illustrating a light source apparatus according to another embodiment of the present invention. The circuit structure of FIG. 9 is similar to the circuit structure of FIG. 4, and only the internal components of the light source adjusting module 350 are different. Therefore, like reference numerals in the two figures denote like elements, and thus their description will be omitted. A difference between FIG. 9 and FIG. 4 is that after the light source adjusting module 350 of FIG. 4 receives the AC voltage signal VAC3, the AC voltage signal VAC3 is processed by the converting unit 410, the counting and storage unit 420 and the DAC 430 to generate the current control signal CCS, while in the light source adjusting module 350 of FIG. 9, the converting unit 410 and the counting and storage unit 420 is substituted by a DAC 810. For example, the DAC 810 can directly perform the digital-to-analog conversion to the received AC voltage signal VAC3 (since it has the pulse nature, it can be regarded as a digital signal), so as to correspondingly generate the aforementioned current control signal for controlling the luminance of the LED 360. Until now, the disclosure is known by those skilled in the art, and detailed description thereof is not repeated. For example, a relationship between an operation result of the DAC 810 and the AC voltage signal VAC3 can be the same as the relationship between the current control signal CCS and the AC voltage signal VAC3 of FIG. 4, and those skilled in the art can design their own DAC 810 complying with such relationship, and such variations are still considered to be within the scope of the present invention.

Figure 10:
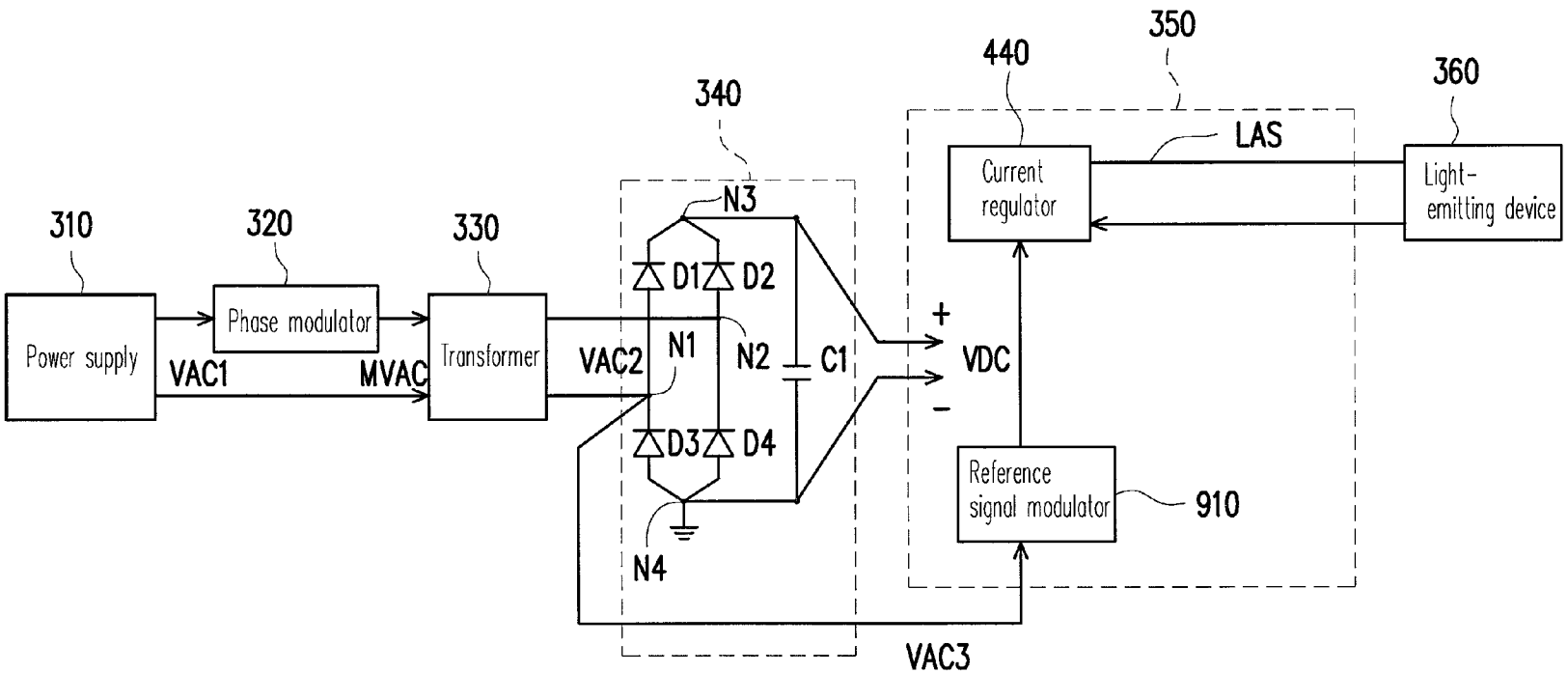
FIG. 10 is a circuit block diagram illustrating a light source apparatus according to still another embodiment of the present invention.

FIG. 10 is a circuit block diagram illustrating a light source apparatus according to still another embodiment of the present invention. The circuit structure of FIG. 10 is the same or similar to the circuit structure of FIG. 4, and only the internal components of the light source adjusting module 350 are different. Therefore, like reference numerals in the two figures denote like elements, and thus their description will be omitted. A difference between FIG. 10 and FIG. 4 is that after the light source adjusting module 350 of FIG. 4 receives the AC voltage signal VAC3, the AC voltage signal VAC3 is processed by the converting unit 410, the counting and storage unit 420 and the DAC 430 to generate the current control signal CCS, while in the light source adjusting module 350 of FIG. 10, a reference signal modulator 910 receives the AC voltage signal VAC3 and correspondingly generates the current control signal CCS according to a state of the AC voltage signal VAC3 (i.e. according to signal waveform variation of the AC voltage signal VAC3). Next, the reference signal modulator 910 transmits the current control signal CCS to the current regulator 440 for follow-up light source adjusting. For example, a relationship between an operation result of the reference signal modulator 910 and the AC voltage signal VAC3 can be the same to the relationship between the current control signal CCS and the AC voltage signal VAC3 of FIG. 4, and those skilled in the art can design their own reference signal modulator 910 complying with such relationship, and such variations are still considered to be within the scope of the present invention.

In summary, the light source adjusting module detects the state of the AC voltage signal VAC2 to obtain information of the modulated AC voltage signal MVAC of the phase modulator, so as to control the luminance of the light-emitting device (LED). By such means, the light source apparatus and the light source adjusting module of the present invention is complied with an MR16 lamp apparatus specification (certainly, can also be complied with E26 and E27 lamp specifications). Therefore, utilization convenience can be improved. Moreover, extra pins and connection of a variable resistor for the light source apparatus are unnecessary, and accordingly fabrication cost of the circuit is reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source apparatus, comprising:

a power supply, for providing a first AC voltage signal;

a phase modulator, coupled to the power supply, for receiving the first AC voltage signal and modulating a conducting phase of the first AC voltage signal to generate a modulated phase adjustable AC voltage signal; wherein the phase information can be adjusted so as to achieve a light-adjusting effect;

an electrical transformer, coupled to the phase modulator, for transforming the modulated AC voltage signal to generate a second AC voltage signal;

a light source adjusting module, coupled to the electrical transformer, for generating a luminance adjusting signal according to a state of the second AC voltage signal; wherein the light source adjusting module comprises:

a converting unit, for receiving the second AC voltage signal and converting the second AC voltage signal into a pulse signal;

a counting and storage unit, coupled to the converting unit, for counting and storing a quantity of pulses of the pulse signal;

a DAC, coupled to the counting and storage unit, for correspondingly generating a current control signal according to the quantity of the pulses of the pulse signal; and a current regulator, coupled to the DAC, for correspondingly generating the luminance adjusting signal according to the current control signal; and a light-emitting device, coupled to the light source adjusting module, for receiving the luminance adjusting signal to generate a corresponding light source.

2. The light source apparatus as claimed in claim 1, wherein each of the pulses of the pulse signal has a same amplitude.

3. The light source apparatus as claimed in claim 1, wherein the light-emitting device is a LED.

4. The light source apparatus as claimed in claim 1, wherein the light source apparatus further comprises:

a rectifier, coupled to the electrical transformer and the light source adjusting module, for transforming the second AC voltage signal into a DC voltage signal, and providing the DC voltage signal to the light source adjusting module to serve as a supply power for the light source adjusting module.

5. The light source apparatus as claimed in claim 4, wherein the rectifier is a bridge rectifier.

6. The light source apparatus as claimed in claim 4, wherein the light source adjusting module generates the luminance adjusting signal according to a voltage signal generated at one input terminal or two input terminals within the rectifier based on the second AC voltage signal.

7. The light source apparatus as claimed in claim 1, wherein a lamp specification of the light source apparatus is MR16, E26 or E27.

8. A light source adjusting module, comprising:

a converting unit, for receiving a modulated AC voltage signal and converting the modulated AC voltage signal into a pulse signal, wherein the modulated AC voltage signal is generated by modulating a conducting phase of an AC voltage signal;

a counting and storage unit, coupled to the converting unit, for counting and storing a quantity of pulses of the pulse signal;

a DAC, coupled to the counting and storage unit, for correspondingly generating a current control signal according to the quantity of the pulses of the pulse signal; and a current regulator, coupled to the DAC, for correspondingly generating a luminance adjusting signal according to the current control signal.

9. The light source adjusting module as claimed in claim 8, wherein the luminance adjusting signal is used for adjusting a light-emitting device coupled to the light source adjusting module.

10. The light source adjusting module as claimed in claim 9, wherein the light-emitting device is a LED.

11. The light source adjusting module as claimed in claim 8, wherein the converting unit receives a voltage signal generated by the modulated AC voltage signal from one input terminal or two input terminals of a rectifier, so as to generate the pulse signal.

12. The light source adjusting module as claimed in claim 8, wherein the light source adjusting module is applied to a light source apparatus with a lamp specification of MR16, E26 or E27.

13. The light source adjusting module as claimed in claim 8, wherein each pulse of the pulse signal has a same amplitude.

14. A light source apparatus, comprising:

a power supply, for providing a first AC voltage signal;

a phase modulator, coupled to the power supply, for receiving the first AC voltage signal and modulating a conducting phase of the first AC voltage signal to generate a modulated phase adjustable AC voltage signal; wherein the phase information can be adjusted so as to achieve a light-adjusting effect;

an electrical transformer, coupled to the phase modulator, for transforming the modulated AC voltage signal to generate a second AC voltage signal;

a light source adjusting module, coupled to the electrical transformer, for generating a luminance adjusting signal according to a state of the second AC voltage signal; wherein the light source adjusting module comprises:

a DAC, for receiving a modulated AC voltage signal and performing a digital-to-analog conversion to the modulated AC voltage signal to generate a current control signal; and a current regulator, coupled to the DAC for correspondingly generating a luminance adjusting signal according to the current control signal; and a light-emitting device, coupled to the light source adjusting module, for receiving the luminance adjusting signal to generate a corresponding light source.

15. The light source apparatus as claimed in claim 14, wherein the luminance adjusting signal is used for adjusting a light-emitting device coupled to the light source adjusting module.

16. The light source apparatus as claimed in claim 15, wherein the light-emitting device is a LED.

17. The light source apparatus as claimed in claim 14, wherein the light source adjusting module is applied to a light source apparatus with a lamp specification of MR16, E26 or E27.

* * * * *